US006247527B1

(12) United States Patent
Paulman

(10) Patent No.: US 6,247,527 B1
(45) Date of Patent: Jun. 19, 2001

(54) FIN ARRAY FOR HEAT TRANSFER ASSEMBLIES AND METHOD OF MAKING SAME

(75) Inventor: Roger Paulman, Barrington, IL (US)

(73) Assignee: Peerless of America, Inc., Lincolnshire, IL (US)

( * ) Notice: Subject to any disclaimer, the term of this patent is extended or adjusted under 35 U.S.C. 154(b) by 0 days.

(21) Appl. No.: 09/551,859

(22) Filed: Apr. 18, 2000

(51) Int. Cl.[7] ..... F28D 1/02
(52) U.S. Cl. ..... 165/152; 165/181; 165/153
(58) Field of Search ..... 165/152, 153, 165/181, 183, 170, 148

(56) References Cited

U.S. PATENT DOCUMENTS

| | | | | |
|---|---|---|---|---|
| 2,252,211 | * | 8/1941 | Seemiller | 165/152 |
| 2,647,731 | * | 8/1953 | Ludlow | 165/153 |
| 3,521,707 | * | 7/1970 | Brown | 165/152 |
| 3,998,600 | * | 12/1976 | Walls | 165/152 |
| 5,511,610 | * | 4/1996 | Lu | 165/153 |
| 5,671,806 | * | 9/1997 | Schmalzried | 165/152 |
| 5,816,320 | * | 10/1998 | Arnold et al. | 165/181 |

FOREIGN PATENT DOCUMENTS

| | | | | |
|---|---|---|---|---|
| 58-45495 | * | 3/1983 | (JP) | 165/152 |

* cited by examiner

*Primary Examiner*—Ira S. Lazarus
*Assistant Examiner*—Terrell McKinnon
(74) *Attorney, Agent, or Firm*—Gardner, Carton & Douglas

(57) ABSTRACT

An improved fin array for use in a heat transfer assembly, such as a condenser for a vehicle air conditioning system, and a method of making the improved fin array, are disclosed. The fin array comprises an elongated one-piece fin member having top and bottom base portions with fin sets extending between adjacent top and bottom base portions. The top and bottom base portions are generally flat for bonding to the heat exchanger tubes, such as by brazing. Each fin set includes a plurality of individual fins extending generally perpendicularly to a longitudinal length of the fin member and having side edges that are longitudinally offset with respect to each other. The offset fin edges provide increased air flow over the individual fins and thus increase the efficiency of the overall heat exchanger. The fins may also be slightly bowed to accommodate for variation in the tolerances of the adjacent tubes. Additionally, the fins may also have a slightly arcuate cross section to impart greater column strength to the fins contained within the improved fin array. The method of making the improved fin array includes a providing a flat sheet of elongated fin stock, pressing a chisel shape into the fin stock to a depth of between 40 to 90 percent of the thickness of the fin stock in order to produce a cut pattern along the length of the fin stock, bending the fin stock into a serpentine pattern, and then compressing the fin stock to finalize the one-piece fin member.

28 Claims, 4 Drawing Sheets

FIN ARRAY FOR HEAT TRANSFER ASSEMBLIES AND METHOD OF MAKING SAME

BACKGROUND OF THE INVENTION

This invention relates to heat exchanger assemblies and more particularly to an improved fin array design for use in a variety of heat exchanger assemblies and a method of making the fin array.

FIG. 1 illustrates a prior art heat exchanger assembly in the form of a condenser typically used in air conditioning units for vehicles. The heat exchanger assembly 10 includes a pair of opposed, spaced, generally parallel headers 11 and 12. The headers 11 and 12 each define a series of generally parallel slots or openings 13 for receiving the ends 14*a* and 14*b* of tubes 14 that extend in fluid communication between the headers 11 and 12. Each of the headers 11 and 12 includes a fitting 15 and a cap 16. The fittings 15 operate as either an inlet or outlet for circulation of fluid through the headers 11 and 12 and tubes 14. The fittings 15 can be operatively connected, such as by tube 17 or other appropriate tubing, to a heat exchanger system such as for a air conditioning unit for a vehicle. The heat exchanger assembly 10 also includes channels or flanges 18 and 19 in order to provide rigidity to the structure.

A plurality of elongated serpentine fins 20 extend between the headers 11 and 12 along each of the heat exchanger tubes 14. Each of the fins 20 follows a serpentine pattern and has rounded crests that are alternately connected to the top and bottom tubes 14 by a process such as brazing.

It is well known in the art that the efficiency of a heat exchanger assembly is mainly limited by the heat flux between the fins and the ambient air, which receives the heat from the system or transmits heat into the system depending upon the application. For example, in the case of mechanical refrigeration systems, it is known that the heat flux per unit of area between the tube walls and refrigerant or between the tube walls and fins is very high relative to the heat flux per unit area between the surrounding air and the fin and tube surfaces. It is also known in the art that the portion of the fin that first cuts through the air has the highest heat flux per unit area.

To improve heat flux between the fins and the ambient air, many heat transfer systems employ a fan to move more air per unit of time across the fins. As another example, moving vehicles such as automobiles typically position the air conditioning condenser on the front of the car to provide maximum air flow across the fin and tube surfaces.

In another system to improve heat flux between the fins and ambient air, the fins are manufactured to include small louvers in each fin that catch the air and force the air to flow past or over the heated or cooled fin surfaces. A fin array 21 including louvers on the fins is shown in the prior art fin assembly of FIG. 2. The fin array 21 is folded in a serpentine pattern to form a series of alternating upper and lower crests 22 and a plurality of individual fins 23. Each of the individual fins 23 includes a plurality of louvers 24.

The elongated fin array 21 is typically manufactured from strips of metal, such as copper or aluminum, that are run through rotary cutting dies that shape the openings in a strip, shape the louvers by pushing them inward or outward from the strip, and then fold the fins using a "star wheel" style roller which imparts a rounded bend to the fin stock. The fin array 21 including louvers 24 on the fins 23 improves the heat flux as compared to traditional non-louvered fins. However, the louvered fins are less than optimal for maximizing heat flux between the fins and ambient air and are difficult and expensive to manufacture.

For example, the louvers 24 on the fins 23 do not extend across the entire length of the individual fins due to the rounded bend area at crests 22 and thus form bypass passageways labeled 25 in FIG. 2. Air can thus pass entirely through the fins 22 at bypass portions 25 without encountering the louvers 24 or substantially contacting the fins 23.

In the louvered fin array 21, the louvers 24 are also aligned directly behind each other such that the air tends substantially to contact only the first row or two of the louvers 24. Thus, the louvers 24 toward the back of the fin set do not "see" fresh air since they are in the shadow of the first louvers.

The louvered fin array shown in FIG. 2 is typically manufactured by cutting the fins in a traditional shearing die technique. With most metals such as copper or aluminum, those skilled in the art know that large amounts of lubrication are required for shear cutting of the material in order to prevent heat build-up in the cutting tools. However, the lubricating oils must be substantially removed from the fins after the cutting process so that the fins are clean for brazing the fins to the tubes. The process of removing the lubricating oils from the fins is an extremely expensive process and results in environmentally dangerous by-products.

This manufacturing process also commonly results in relatively large fin height variations that can lead to poor bonding between the fins and tubes. As a consequence of tolerance build up, added to run by run in the full assembly process, the rounded upper and lower crests of the fin array may not allow for complete fin to tube contact if the tubes are thinner than normal or if the fins have been folded with too small of a height. Poor bonding between the fins and tubes can dramatically decrease the efficiency of the entire heat exchanger assembly. If, on the other hand, fins have been folded with too great a height and/or tubes are thicker than normal, then some runs of the fins may be crushed out of shape allowing increased (or decreased) by-pass (or breakage). Both of which are detrimental to heat transfer.

In the prior art manufacturing processes, it is well known to apply pressure to the stacked fins and tubes during the assembly process to ensure adequate contact between the fins and tubes prior to brazing. However, the fins must have sufficient physical vertical strength so that the fins will not collapse under this pressure. Typically, the fins in such heat exchanger assemblies are straight or flat along their horizontal width or such cross section, and such a flat structure only provides a minimum column strength to the structure.

SUMMARY OF THE INVENTION

An important aspect of this invention lies in providing an improved fin array for a heat transfer assembly that provides improved heat flux between the fins and the ambient air and that permits more efficient and economical manufacturing than prior art fin arrays including louvers. The fin array of the present invention comprises an elongated serpentine one-piece fin member having top and bottom base portions connected together by fin sets extending between adjacent ones of the top and bottom base portions. The fin sets each include a plurality of individual fins having side edges facing generally perpendicular to a longitudinal length of the one piece fin member. The side edges of the fins are also longitudinally offset with respect to each other to improve heat flux with the passing air.

The fin sets are divided into a plurality of individual fins that have offset sides edges which greatly increase the heat flux of the entire fin member. The side edges of the fins typically provide the greatest amount of heat flux and the offset nature of the side edges of the fins maximizes this heat flux since each of the edges sees fresh air.

The top and bottom base portions of the fin unit extend respectively in top and bottom planes and are generally flat. The flat nature of the top and bottom base portions permits solid bonding and increase surface area in contact with the heat exchanger tube to increase overall heat transfer. The flat configuration of the top and bottom base portions or crests also provides a better and more stable connection than prior art fins having rounded crests.

The top and bottom base portions generally comprise elongated, flat sections that extend transversely at an angle with respect to the longitudinal length of the fin member. The base portions are formed of staggered sections, that may comprise either rectangles or squares, in order to longitudinally offset the side edges of the fins. This permits dense packaging of the fins and their side edges to fully meet and engage oncoming air in order to improve heat flux.

In that regard, the fins preferably extend at a generally perpendicular angle (about 90°) with respect to the junction with the top and bottom base portions. The fins then extend completely between the top and bottom heat exchanger tubes to maximize heat transfer. This configuration also prevents formation of "passage ways" that could otherwise allow air to pass through the fin without contacting any of the fin or tube surfaces.

In an embodiment, the fins are slightly bowed or generally have an arcuate shape as they extend between the top and bottom base portions. The bowed fins impart flexibility to the fin array. Due to this flexibility, the fin stack can be pressed to adjust for variances in the tolerances of the tubes positioned between the fin arrays. This guarantees good contact between each fin array and each tube throughout the assembly regardless of minor variations in tube tolerances throughout the assembly.

The inventive fin array of the present invention can advantageously be manufactured without the use of shearing devices or associated lubrication oils, which otherwise can make the manufacturing process unduly complicated, expensive, and harmful to the environment. In particular, the method of manufacturing the inventive heat array includes providing a flat sheet of fin stock and then positioning the fin stock between chisel and an anvil. The chisel is then pressed or impacted into the fin stock so that the chisel penetrates the fin stock to about 40 to 90 percent of the thickness of the fin stock in order to define a cut pattern along the length of the fin stock. In all metallic fin stock materials, the chisel shape does not penetrate entirely through the material since lateral forces applied by the chisel to the fin material will exceed the ultimate strength of the remaining fin material which will then split through completely. The cut pattern thus achieving the plurality of top base portions, bottom base portions, and fin sets extending between the top and bottom base portions.

By using an chiseling method of forming the cut pattern on the fin stock, the method of the present invention avoids use of shears and lubricants such as in the prior art processes of forming fin arrays.

After the cut pattern is formed on the fin stock, the fin stock is bent by passing the fin stock through a pair of star rollers or other similar device. The fin stock is thus bent into a serpentine pattern so that the top base portions extend in a common top plane, the bottom base portions extend in a common bottom plane, and the fin stock extend between and connect adjacent ones at the top and bottom base portions. At this stage in the manufacturing process, the fin extends at an angle greater than 90° with respect to the top and bottom portions to permit the fin stock to roll off of and be removed from the star rollers or other forming device.

In an embodiment where the fins have a slightly bowed or arcuate configuration, the star roller or other similar device may include lobed wheels for imparting a bow to each of the individual fins. The lobed wheels impart bows that are in opposite directions for each succeeding fin set such that, when the entire fin array is folded, the fins within each fin set will all have bows in the same direction and of equal degree.

After passing through the star rollers, the fin stock is in an uncompressed fin member shape with the fins being angled with respect to the top and bottom base portions. The fin stock is then placed in a compression device where the ends of the fin stock are urged together until the fins extend generally perpendicular (about 90°) with respect to the top and bottom base portions. The manufacturing of the fin stock into the completed one piece fin member is then complete.

In addition to avoiding the complexity, cost, and environmental concerns of prior art manufacturing processes, the method of the present invention provides a further advantage in that the impact step of forming the cut pattern in the fin stock results in the fins having serrated or roughened edges. The roughened or serrated edges on the fins have increased surface area on a microscopic level and thus improve heat flux with the surrounding environment.

In an embodiment of the fin array having slightly bowed or arcuate fins, this flexible fin array is also highly advantageous in that it accounts for and compensates for variances in the tolerances of the tubes that are interposed between the fin arrays. The fin array is preferably formed to have a fin height that is higher than the highest tolerance allowed between the tubes in the final heat exchanger assembly, and the fin arrays are then compressed between the tubes due to the springiness or flexibility of the slightly bowed or arcuate fins. This compression of the fin array ensures good contact between the fins and the tubes, and thus facilitates and increases heat transfer between the fins and tubes. This also permits the fin arrays, or even individual fins within the arrays, to compensate for variances in the tolerances of the tubes. This fin array is significantly advantageous over prior art fin arrays wherein the fin height of the entire fin array was required to be uniform, whereas individual fin sets, or even individual fins, within the inventive fin array can be adjusted to compensate for variations in the tolerances in the tubes in the final heat exchanger assembly.

In an embodiment, the fins are also slightly bowed or arcuate along the horizontal width or cross sections of the fins. These fins form a plurality of slightly bowed or cupped columns along the fin array. The slightly bowed or cupped fins provide significantly greater vertical or column strength to the fin array than prior art fins that are flat in cross section. Accordingly, during assembly and application of pressure to secure the fins to the tubes prior to brazing, the improved fins having a curved or cupped cross section provide enhanced column strength to prevent inadvertent collapse of the fin array during the assembly process.

In such an embodiment with cupped fins, the fins may also derive further column strength from the manufacturing process by which the fins are formed. In particular, the use of a chisel and anvil to cut the fin pattern into the fin material described above results in work hardening of the edges of the fin. This work hardening further enhances the column strength of the cupped or curved fins. Additionally, the fins may be passed through two pinch rollers after the cutting process to somewhat flatten the cupped fins so that they only have a slightly bowed or arcuate shape. This process results in the fins still having a cupped cross section that further enhances the column strength of the fin but also imparts additional strength due to the additional work hardening performed during the rolling process.

Other objects, features and advantages of the present invention will become apparent from the following description and drawings in a vehicle.

DESCRIPTION OF THE PREFERRED EMBODIMENTS

Figure 2:
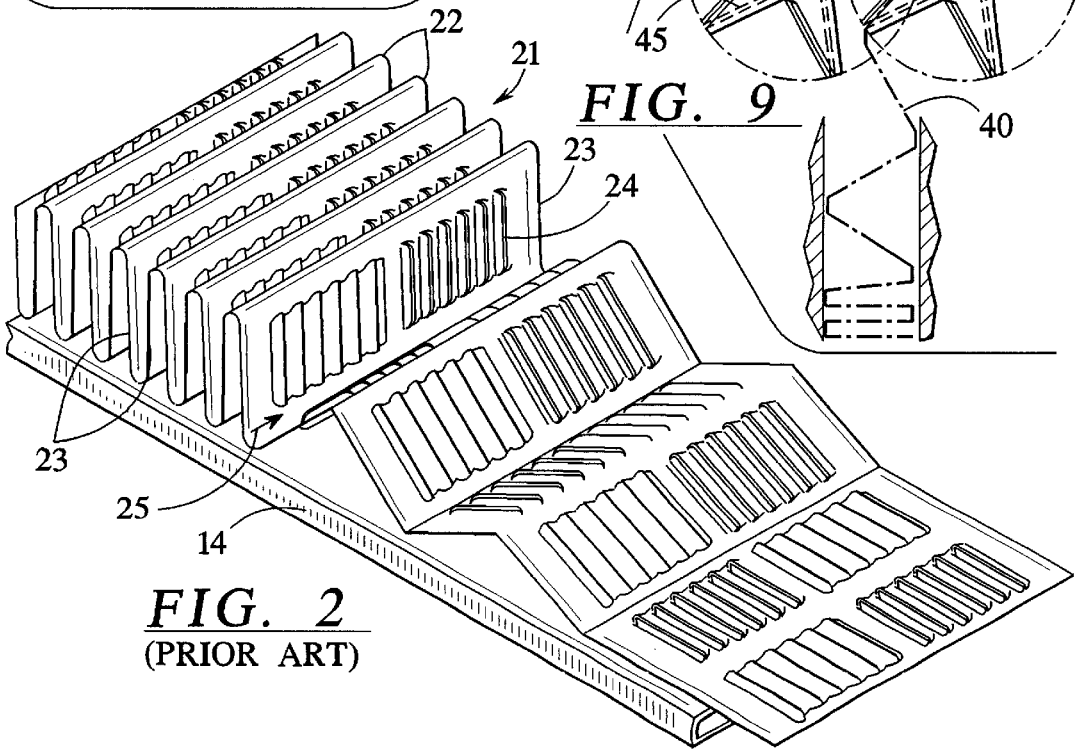
FIG. 2 (PRIOR ART)
FIG. 2 is a perspective view of a prior art fin array including louvers.
Figure 3:
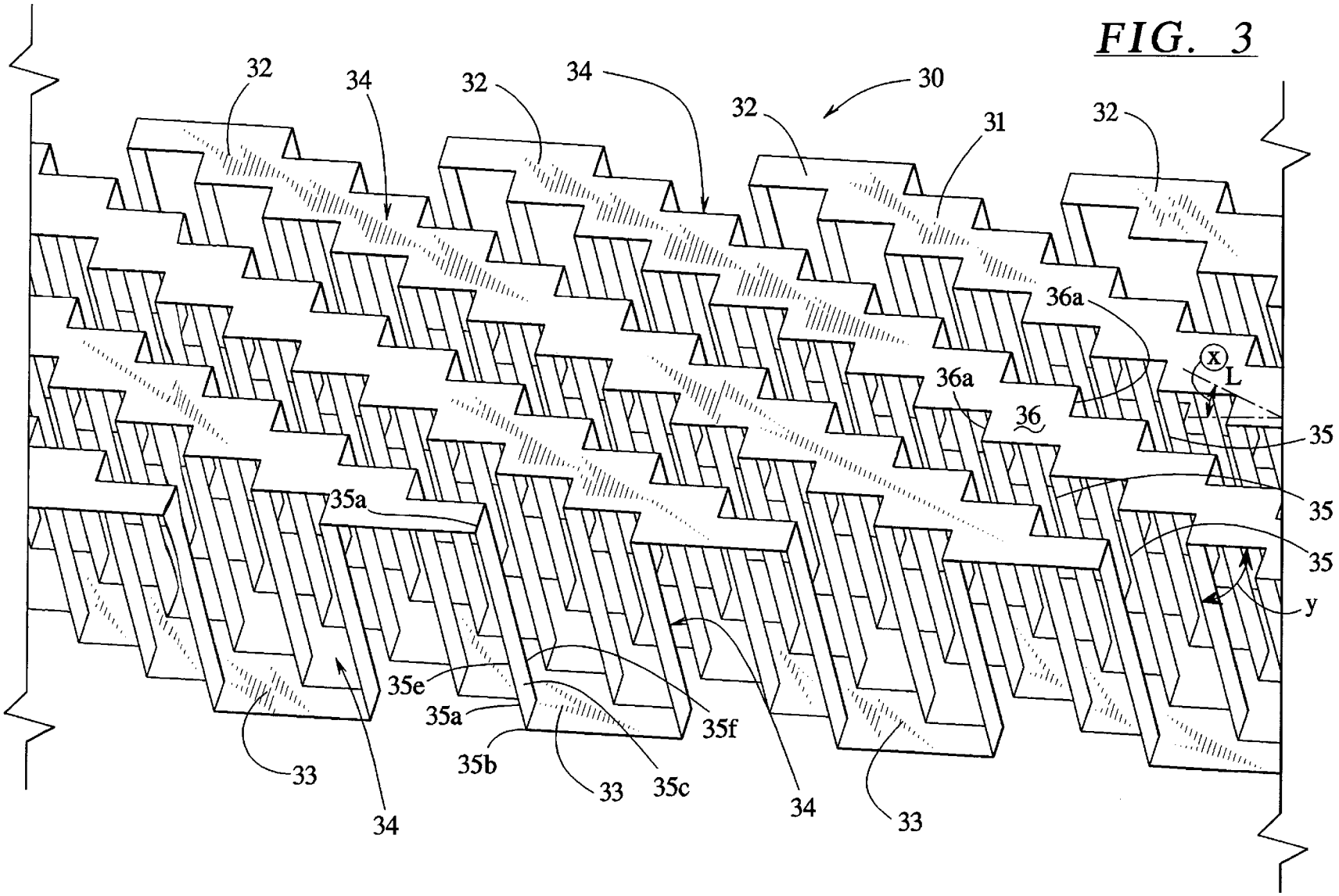
FIG. 3 is a perspective view looking down on the top and side of the improved fin array of the present invention.
Figures 4, 5, 6, 7, 8, 10, 12, 13:
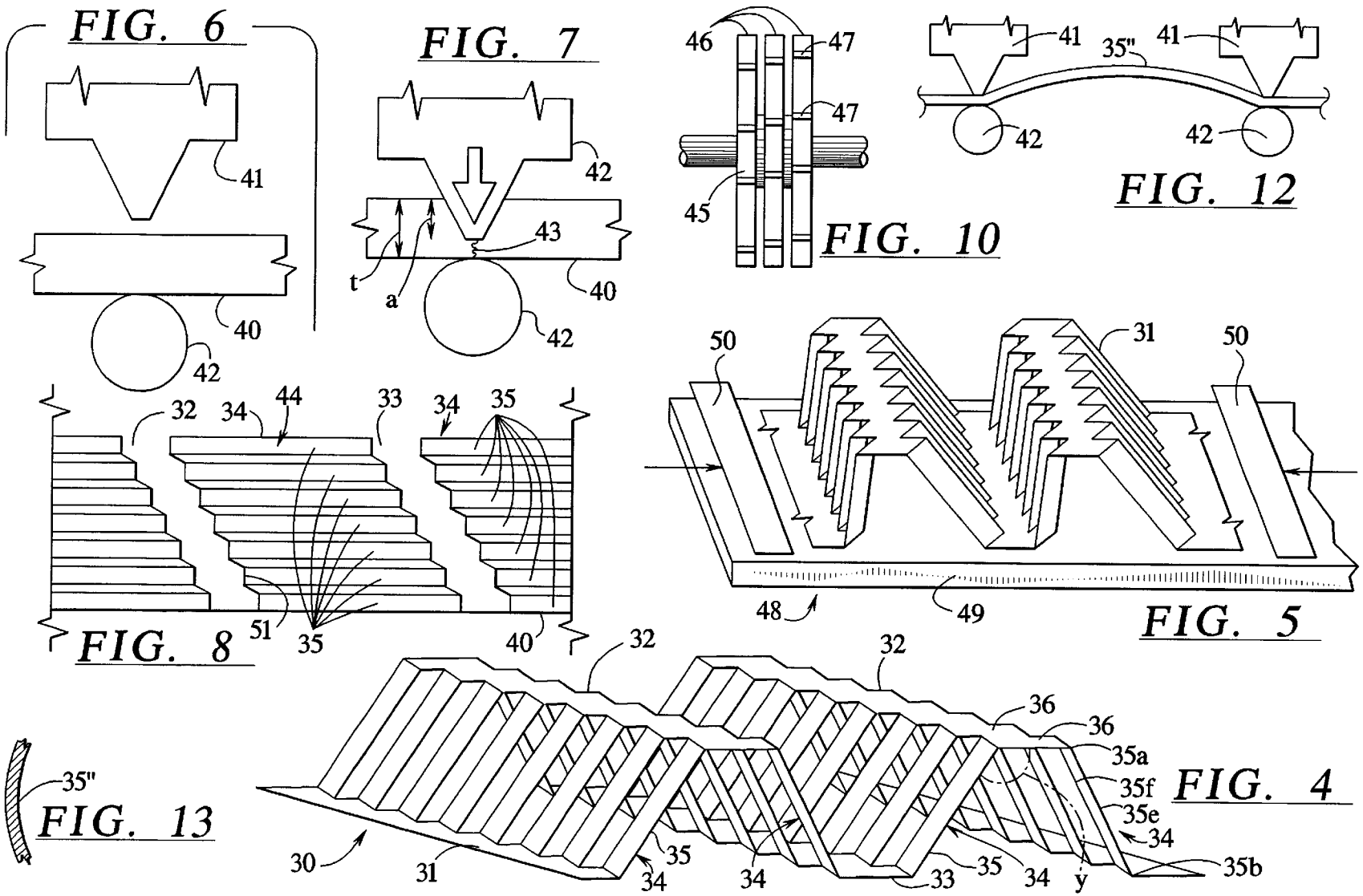
FIG. 4 is a front, somewhat perspective view, illustrating the improved fin array of the present invention in an uncompressed condition.
FIG. 5 is a front, somewhat perspective view, illustrating the improved fin array of the present invention in an uncompressed condition.
FIG. 6 is a schematic side view illustrating the step of scoring a sheet of fin stock for forming the improved fin array of the present invention.
FIG. 7 is a schematic side view illustrating the step of scoring a sheet of fin stock for forming the improved fin array of the present invention.
FIG. 8 is a top view of a scored piece of fin stock used for forming the improved fin array of the present invention and includes an enlarged view of some of the scored pattern.
FIG. 10 is a schematic top view of the star rollers shown in FIG. 9 and used to form the fin stock into the improved fin array of the present invention.
FIG. 12 is a schematic side view illustrating the step of scoring the fin stock around an individual fin that has a slightly curved or arcuate cross section.
FIG. 13 is a top view schematically illustrating a cross section of one staggered row of fins in an embodiment of the fin array of the present invention.

Referring to FIGS. 3–5, the numeral 30 generally designates the improved fin array of the present invention. The fin array 30 comprises an elongated one-piece fin member 31 having a longitudinal axis or length L. The fin array 30 can advantageously be used as a more efficient substitute to the fin array 20 or 21 shown in the prior art condenser structures in FIGS. 1 and 2. While the inventive fin array 30 can advantageously be used in such condensers, it will be understood by those skilled in the art that the improved fin array can be used in a variety of different heat exchanger assemblies within the scope of this invention.

The one-piece fin member 31 is comprised of a serpentine pattern of alternating top and bottom base portions 32 and 33. A plurality of fin sets generally designated at 34 extend between and connect adjacent ones of the top and bottom base portions 32 and 33. Each of the fin sets 34 includes a plurality of individual fins 35 to maximize heat transfer with ambient air.

The top base portions 32 are all positioned in a common flat top plane and the bottom base portion 33 are also disposed in a common flat bottom plane. The flat construction of the top and bottom base portions 32 and 33, as compared to the rounded crests 22 of a traditional fin array, permit a solid bond to be formed within an adjacent heat exchanger tube 14. The top and bottom base portions 32 and 33 also maximize surface area contact with the tube 14 due to their flat (as opposed to rounded) configuration, which further maximizes heat transfer between the fins and the tubes.

As shown in the figures, the top and bottom base portions 32 and 33 comprise elongated flat sections that extend transversely at an angle with respect to the longitudinal length of the one piece fin member 31. Generally, the angle designated with an X in FIG. 3 is about 45° but may fall generally within a range of about 15° to 18°. Along this generally transverse line, the top and bottom base portions 32 and 33 comprise a plurality of staggered segments 36 generally having a quadrilateral configuration such as in the form of either a rectangle or a square, but other shapes may be employed. The segments 36 are connected to each other in a staggered fashion to form the top and bottom bases 32 and 33. The segments 36 also include ends 36*a* that merge into fins 35 and the segments 36 generally have a width equal to the width of two of said fins 35. The fins 35 can then project downwardly from opposed ends 36 on each side of each of the segments 36 in a staggered fashion as shown in the drawings.

In the embodiment given in the drawings, each of the fin sets 34 comprises eight individual fins 35 extending between the adjacent ones of the top and bottom base portion 32 and 33. However, the fin sets 34 may generally include between one and twenty individual fins 35 or more depending upon the application. It will be also understood by those skilled in the art that the number of fins contained within each fin set may be varied considerably depending upon the size and nature of the particular application for which the fin array 30 is used.

Each of the fins 35 includes top and bottom edges 35*a* and 35*b* respectively merged with top and bottom base portions 32 and 33. The fins 35 also include a pair of top and bottom faces 35*c* and 35*d* and a pair of side edges 35*e* and 35*f*. The side edges 35*e* and 35*f* extend between and connect the top and bottom base portions 32 and 33.

Due to the angled transverse alignment of the top and bottom base portions 32 and 33, each of the fins 35 within a fin set 34 has its side edges 35*e* and 36*f* longitudinally offset with respect to the edges 35*e* and 35*f* of all of the other fins 35 in each fin set 34. The offset positioning of the fins 35 and side edges 35*e* and 35*f* maximizes heat transfer of the fins 35 with the ambient air because the offset fin edges provide maximum exposure to the air and the fins do not block air with respect to each other. The edges 35*e* and 35*f* of the fins 35, as well as the front and rear faces 35*c* and 35*d*, are preferably perpendicular to the longitudinal length L of the fin member to maximize air flow and to keep air side pressure drop to a minimum across the fins 35. However, it will be understood by those skilled in the art that the fins 35 could be angled with respect to how each fin 35 presents itself to the air depending upon the particular application for which the fin array 30 is intended.

The fins 35 have fin ends 35*a* and 35*b* that extend generally perpendicularly from and merge with the side edges 36*a* of the segments 36 of the top and bottom connecting portions 32 and 33. The angle at the juncture between the base portions and the fins 35 is generally designated with a Y in the drawings. The angle Y between the base portions 32 and 33 and fins 35 is preferably perpendicular or generally 90° so that the fins 35 extend completely between the top and bottom base portions and the adjacent tubes brazed or otherwise connected to the base portions 32 and 33. This maximizes heat transfer between the fins 35 and the heat exchanger tubes 14. Because the fins 35 extend completely between the adjacent tubes 14, the fins 35 also do not define bypass portions such as found at the top and bottom of the louvered fins shown in FIG. 2 and described above.

FIG. 4 shows the fin array 30 in an uncompressed state just prior to completion of manufacture of the fin array 30. In such uncompressed condition, the fin array 30 is substantially complete as described in connection with FIG. 3 except that the fins 35 form an angle greater than 90° with the top and bottom connecting portions 32 and 33. However, FIG. 4 makes it easier to see the individual components that make up the final fin array structure 30.

Figure 1:
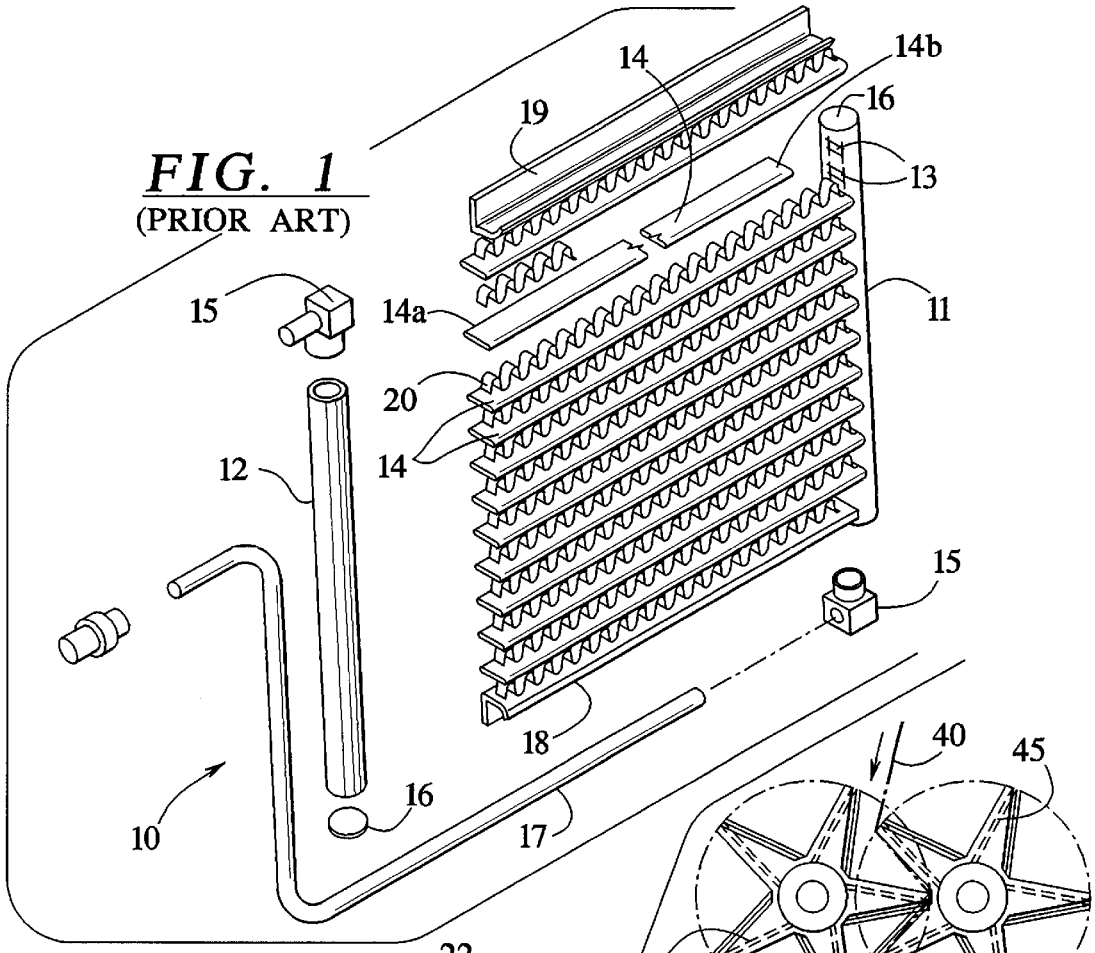
FIG. 1 (PRIOR ART)
FIG. 1 is a perspective view of a prior art heat exchanger assembly in the form of a condenser for an air conditioning system.
Figure 9:
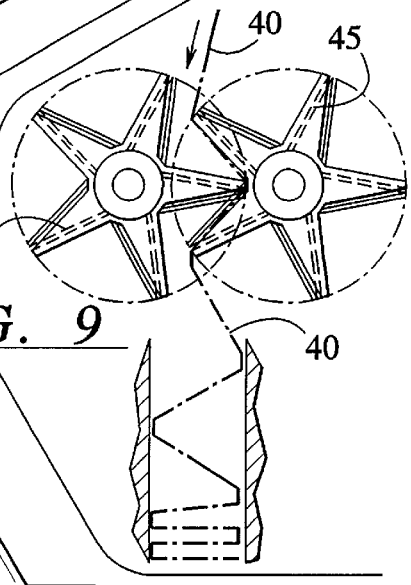
FIG. 9 is a schematic side view showing the step of passing the fin stock through a pair of star rollers to form the fin array of the present invention.

The fin array 30 is preferably made of a metallic material such as aluminum, copper, or other suitable heat exchanger materials. In condenser application such as shown in FIG. 1, the fin array 30 may be comprised of rolled aluminum fin stock or other suitable materials. While these materials are believed to be desirable, it will be understood by those skilled in the art that other suitable or appropriate heat exchanger materials could be used to form the fin array 30.

FIGS. 4–10 generally show the method of making the inventive fin array 30. Referring to FIG. 8, the method involves first providing an elongate piece of fin stock generally designated at 40 in FIGS. 6–8. The fin stock 40 is positioned between a chisel 41 and an anvil 42 as show in FIG. 6. The chisel 42 is then pressed or impacted into the fin stock 40 over the anvil 42 so that the chisel 42 penetrates the fin stock 40 to between about 40 to 90 percent of its thickness T to a depth D. This chiseling action fractures the remaining thickness of fin stock 40 as designated at 43. The chisel 41 and anvil 42 are used to define a cut pattern 44 on the flat fin stock 40 as shown in FIG. 8. It should be understood that the term "chisel" refers to various forms of rotary dies on which a pattern of chisel-like edges have been machined. The cut pattern 44 defines the top base portions 32, the bottom base portions 33, and the fin sets 34 comprised of individual fins 30 therebetween on the fin stock.

Advantageously, during the above-described impacting process of forming the cut pattern 44 on the fin stock 40, the chisel 41 and anvil 42 never come into contact. Thus, no lubrication is required such as in prior art shearing processes. Thus, this manufacturing method avoids the expensive use of lubricants, the expensive step of removing the lubricant from the heat exchanger components and the expense associated with the environment and any dangerous byproducts from the lubrication removal process. Tool life is also expected to be greater since close tolerance of shearing edges are not required in this type of cutting.

After the cut pattern 45 is formed on the fin stock 40, the fin stock 40 is bent to form the fin array in the uncompressed state shown in FIG. 4 by passing the fin stock 40 through a pair of star rollers 45 shown in FIG. 8. The star rollers 45 are generally known in the art for forming serpentine patterns in pieces of fin stock 40. The star rollers 45 used in conjunction with the present method are different in that they are comprised of a plurality of individual star rollers 46 that include offset portions 47 for forming the offset fins 35 in the fin stock 40. The star rollers 45 are designed to create an angle Y between the fins 35 and the top and bottom base portions 32 and 33 that is greater than 90° so that the fin stock 40 will easily roll off of the star rollers 45 during the manufacturing process. If the star rollers were designed to impart an angle of 90° between the fins 35 and the top and bottom base portion 32 and 33, it is believed that the star rollers could become trapped within the 90° angle of the components.

After passing through the star rollers 45, the fin stock 40 is in the uncompressed shape of a semi-complete fin member 31 shown in FIG. 4. Thereafter, the fin member 31 is placed in a compression device 48, which includes platform 49 and a pair of presses 50. The presses 50 are used to compress the ends of the fin member 31 until the fins 35 are all extending at an angle of approximately 90° with respect to the top and bottom base portions 32 and 33.

As shown in FIG. 8, the cut pattern 44 includes slices or cuts 51 between the fins 35 and the top and bottom base portions 32 and 33. The cuts or slices 51 ensure a square bend between the fins 35 and the top and bottom bases 32 and 33 and avoid formation of rounded crests such as in the prior art. The cuts or slices 51 may be to the same depth as the cuts used to form the fins 35 but do not cover the entire width of fins 35. Instead, the cuts or slices 51 may be about 40% to 60% of the width of the fins 35. The purpose for this partial cut is to cause the material to bend at that point (in the star roller) but not to break apart, thus maintaining the interior of the fin set.

After the compression device 48 is used to form 90° bends between the fins 35 and the top and bottom base portions 32 and 33, the fin array 30 is then complete as shown in FIG. 3. The fin array 30 can then be brazed or otherwise bonded to tubes 14 to form a completed heat exchanger assembly.

The process of using the chisel 41 and anvil 42 to create fractured cuts between the fins 35 results in the fins 35 having serrated or otherwise rough edges 35*e* and 35*f*. The serrated or rough edges 35*e* and 35*f*, at least on a microscopic level, have a greater surface area than shear cut fin edges. Thus, the serrated edges with the greater surface area provide for increased heat transfer between the fin edges and the ambient air.

Figure 11:
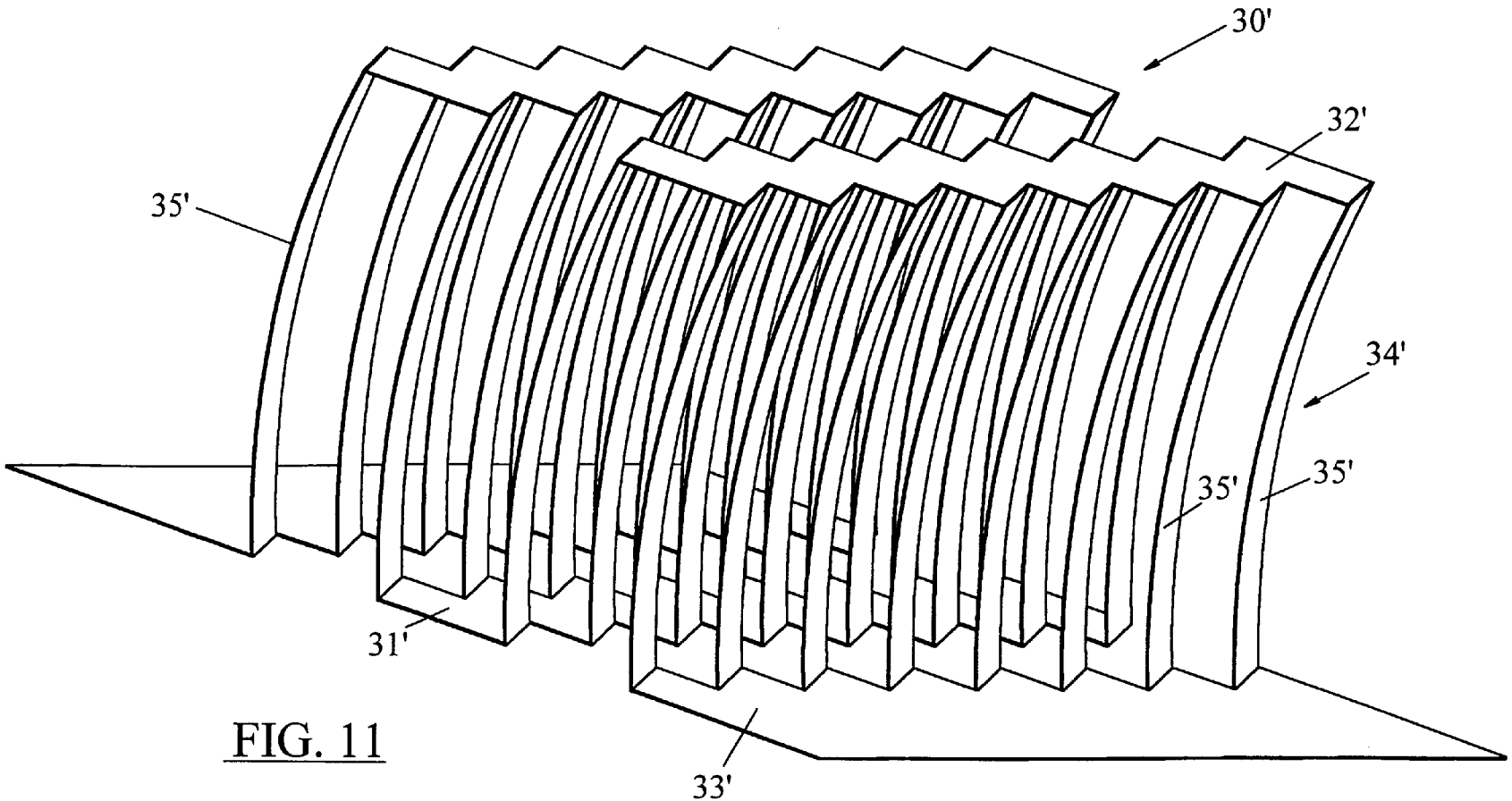
FIG. 11 is generally a perspective view of an improved fin array of the present invention including bowed fins.

FIG. 11 illustrates an alternate embodiment of the fin array 30'. The fin array 30' is substantially similar to the fin array 30 and includes top and bottom portions 32' and 33' with a plurality of fin sets 34' extending therebetween. The main difference is that the fin sets 34' include slightly bowed or arcuate individual fins 35' rather than straight fins 35. The slightly bowed or arcuate fins 35' project generally perpendicularly from the top and bottom portions 32' and 33', but are bowed along their lengths between the top and bottom portions 32' and 33'. As shown in FIG. 11, the slightly bowed or arcuate fins 35' are all preferably bowed in the same direction and slightly bowed or arcuate to the same degree.

The fin array 30' having slightly bowed or arcuate fins 35' is particularly advantageous because it imparts flexibility to the fin array 30' for accommodating slight adjustments due to variances in the tolerances of the tubes that extend between the fin arrays. While it is envisioned that the fin array of the present invention will have little or no tolerance variation, the tubes that are interposed between the fin arrays will still have tolerance variations. To help adjust to these tolerances of the tubes, the fin array 30' has a certain degree of flexibility due to the slightly bowed or arcuate fins 30'. The fin heights are preferably designed with the bows such that the completed fin array will be higher than the highest tolerance allowed between adjacent tubes in the final exchanger assembly. When the fins arrays 30' are then assembled between the tubes, the fin arrays 30' will be slightly compressed between the tubes, which will guarantee a snug contact between the fin arrays and the tubes. This improved contact also facilitates heat transfer between the fin arrays and the tubes. As the fin arrays 30' are compressed between the tubes, this arrangement ensures good contact between the fins and tubes throughout the assembly regardless of variations in the tube tolerances that occur throughout the assembly.

In order to manufacture the fin array 30' with the slightly bowed or arcuate fins 35', the same process can be used as described above except that the star roller or other similar mechanism will include lobed wheels. The lobed wheels on the star rollers will form bows in opposite directions for each succeeding fin segment such that, when the entire fin set is complete, all of the bows will be in the same direction and of an equal amount.

In manufacturing the fin array 30', the individual fins 35' will have some springiness and thus there should be some control over registration of the precut fins as they pass through the fin folding equipment. The springiness of the fins allows the material to be stretched by varying amounts as it enters the folding equipment and the springiness can be used to maintain the registration of the material through the process. The registration can be controlled by notching the fins every few feet, and the notches will allow light operated scanners to control the amount of stretch required to keep the precut fin material properly registered through the bowing and folding equipment.

Referring to FIGS. 12 and 13, an alternate embodiment of the configuration of the individual fins 35 is shown in the form of cupped fin 35". The slightly bowed or cupped fins 35" are formed as described above using chisels 41 and anvils 42 to form score lines along each side of the fin, and the impacting process causes the fin 35" to have a slightly bowed or cupped cross section. The slightly bowed or cupped cross section of the fin extends along the horizontal width of the fins 35" and provides significantly greater column strength than fins that are flat along their horizontal width or in cross section.

As shown in FIG. 13, a plurality of slightly bowed or cupped fins 35" form one of the rows of fins in the fin array. As shown, the fins 35" have a slight bow that forms an arcuately shaped cup in the horizontal direction or cross section of the fin in order to form a curved column. These curves or cupped fins 35" are significantly stronger than fins that a straight or flat cross section in order to resist collapse or bending when they are compressed between rows of tubes in the final assembly process of the heat exchanger assembly.

The fins 35" add additional column strength to their structure due to the fact that the chisels 41 an anvils 42 are used to score or fracture the edges of the fins 35' during the manufacturing process. The process of working the fin 35" with the chisel and anvils 41 and 42 work hardens the edges of the materials to impart further column strength to the fins 35".

In order to impart additional column strength to the fins 35", the fins 35" can be passed through a standard set of pinch rollers after the scoring process in order to slightly flattened the curved or cupped fins 35". The final fins 35" will still have a slightly bowed or cupped construction, with a slight flatten of the fins 35" and a set of rollers will additionally work harden the fins. This additional work harden to the fins will further increase the column strength of the fins 35" in the final assembly.

The design of the fin array 30 of the present invention maximizes heat transfer by providing a plurality of offset fin cutting edges to maximize contact with the air and to maximize heat flux with the ambient air. The flat configuration of the top and bottom base portions 32 and 33 also improves heat transfer by increasing the surface area and contact with the tube and by permitting the fins 35 to run completely between the adjacent tubes. Because the fin array 30 of the present invention maximizes heat transfer, the fin array permits smaller overall size of the completed heat exchanger, which thus saves on material, space and cost. The method of manufacturing the inventive fin array 35 is also advantageous in that it avoids the expensive and complex shearing operations and lubrications required in forming prior art fin arrays.

Although modifications and changes may be suggested by those skilled in the art, it is the intention of the inventor to embody within the patent warranted hereon all changes and modifications as reasonably and properly come within the scope of his contribution to the art.

I claim as my invention:

1. A fin array for a heat exchanger assembly comprising:

an elongated serpentine one-piece fin member having top and bottom base portions that comprise a plurality of flat staggered segments that extend transversely at an angle with respect to the longitudinal length of the one-piece fin member, with a fin set extending between adjacent ones of said top and bottom base portions;

each of said fin sets including a plurality of fins each having side edges facing generally perpendicular to a longitudinal length of said one-piece fin member and being longitudinally offset with respect to each other, each of said plurality of fins being slightly bowed between said top and bottom base portions.

2. The fin array of claim 1 in which said top and bottom base portions are generally flat.

3. The fin array of claim 1 in which said segments comprise either a rectangle or a square.

4. The fin array of claim 1 in which said segments each have a width substantially equal to a width of two of the fins in the fin sets.

5. The fin array of claim 1 in which each of said segments includes ends merging into ends of respective ones of said fins in said fin sets, and in which a juncture between said segments and said fins includes a score line to facilitate bending between the segments and the fins.

6. The fin array of claim 1 in which each of said fins in said fin sets has top and bottom surfaces extending generally transverse to the longitudinal length of said one-piece fin member.

7. The fin array of claim 1 in which each of said fins in said fin sets defines a gap between an adjacent one of said fins.

8. The fin array of claim 1 in each of said fin sets includes one to twenty fins.

9. The fin array of claim 1 in which said side edges of said fins are serrated to improve heat flux with a surrounding environment.

10. The fin array of claim 1 in which each of said fins has a slightly arcuate cross section.

11. A heat transfer assembly comprising:

a pair of tubular headers defining a plurality of slots;

a plurality of tubes extending between said headers and heaving ends inserted into said slots on said headers;

a plurality of elongated one-piece fin members extending between said headers and being positioned along said plurality of tubes, each of said elongated one-piece fin members defining a serpentine pattern of alternating top and bottom base portions connected together by fin sets extending between adjacent ones of said top and bottom base portions, said fin sets each including a plurality of slightly bowed individual fins; and said top and bottom base portions being comprised of a plurality of staggered flat sections that extend transversely at an angle with respect to the longitudinal length of the one-piece fin member.

12. The heat transfer assembly of claim 11 in which each of said plurality of fins has side edges facing generally perpendicular to a longitudinal length of said one-piece fin member and being longitudinally offset with respect to each other.

13. The heat transfer assembly claim 11 in which said segments comprise either a rectangle or a square.

14. The heat transfer assembly of claim 11 in which said segments each have a width substantially equal to a width of two of the fins in the fin sets.

15. The heat transfer assembly of claim 11 in which each of said segments include ends merging into ends of respective ones of said fins in said fin sets, and in which a juncture between said segments and said fins includes a score line to facilitate bending between the segments and the fins.

16. The heat transfer assembly of claim 11 in which each of said fins in said fin sets has top and bottom surfaces extending generally transverse to the longitudinal length of said one-piece fin member.

17. The heat transfer assembly of claim 11 in which each of said fins in said fin sets defines a gap between an adjacent one of said fins.

18. The heat transfer assembly of claim 11 in each of said fin sets includes one to twenty fins.

19. The heat transfer assembly of claim 11 in which said side edges of said fins are serrated to improve heat flux with a surrounding environment.

20. The heat transfer assembly of claim 11 in which each of said fins has a slightly arcuate cross section.

21. A method of making a fin array for a heat exchanger assembly comprising:

providing a flat sheet of elongated fin stock;

positioning said fin stock between a chisel and an anvil;

pressing said chisel on said fin stock so that said chisel penetrates said fin stock to between about 40 and 90 percent of a thickness of the fin stock in order to define a cut pattern along a length of said fin stock, said cut pattern defining a plurality of top base portions, bottom base portions, and fin sets extending between the top and bottom base portions; and bending said elongated fin stock along said cut pattern to form a serpentine pattern so that said top base portions extend in a top plane, said bottom base portions extend in a bottom plane, and said fin sets extend between and connect adjacent ones of said top and bottom base portions to form a one-piece fin member, said fin sets being least to include a plurality of slightly bowed individual fins.

22. The method of claim 21 in which said bending step further comprises bending said each of said plurality of individual fins to have side edges positioned perpendicular to a longitudinal length of said fin member and being longitudinally offset with respect to each other.

23. The method of claim 21 in which said bending step further includes bending said top and bottom base portions to comprise flat sections that extend transversely at an angle with respect to a longitudinal length of said one-piece fin member.

24. The method of claim 21 in which bending step comprises bending said fin sets to include a plurality of fins that extend at an angle to said top and bottom base to form an uncompressed fin member and said method includes the further step of compressing said uncompressed fin member so that said fins extend at about a 90° angle from said top and bottom connecting portions.

25. The method of claim 21 in which said pressing step includes pressing said fin stock so that a plurality of fins in each of said fin sets includes serrated side edges to improve heat flux with a surrounding environment.

26. The method of claim 21 in which said pressing and bending steps include forming each of said fin sets to include one to twenty separate fins.

27. The method of claim 21 in which said of pressing said chisel to form said cut pattern includes pressing the chisel on each side of each of said fins in order to impart a slightly arcuate cross section to each of said fins.

28. The method of claim 21 in which said method includes the further step of passing said fins stock to a pair of rollers to slightly flatten, and additionally work harden, said fins having a slightly arcuate cross section.

* * * * *